United States Patent [19]

Hung

[11] Patent Number: 4,976,175

[45] Date of Patent: Dec. 11, 1990

[54] MULTIPURPOSE TOOL

[76] Inventor: Hsi-Chiang Hung, 2F, No. 19, Lane 284, Shiang Shang North Rd., West District Taichung, Taiwan

[21] Appl. No.: 421,957

[22] Filed: Oct. 16, 1989

[51] Int. Cl.[5] ..... B25B 23/00

[52] U.S. Cl. ..... 81/439; 81/177.5; 81/490

[58] Field of Search ..... 81/52, 439, 177.5, 440, 81/490

[56] References Cited

U.S. PATENT DOCUMENTS

| | | | |
|---|---|---|---|
| 4,572,038 | 2/1986 | Graham | 81/439 |
| 4,644,831 | 2/1987 | Yang | 81/439 X |
| 4,653,356 | 3/1987 | Golden | 81/439 X |

*Primary Examiner*—James G. Smith

*Attorney, Agent, or Firm*—Bacon & Thomas

[57] ABSTRACT

A multipurpose tool is provided with a revolver for storing a plurality of different tool bits which may be indexed by a trigger mechanism and selectively disposed in a position of use at the end of a barrel by a retractable shaft. The device includes a hollow handle provided with a removable cover to form a compartment for storage of accessory parts.

6 Claims, 5 Drawing Sheets

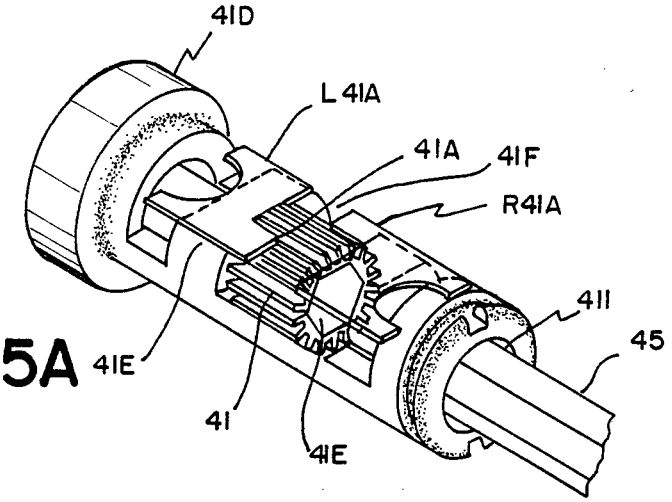
FIG.5A
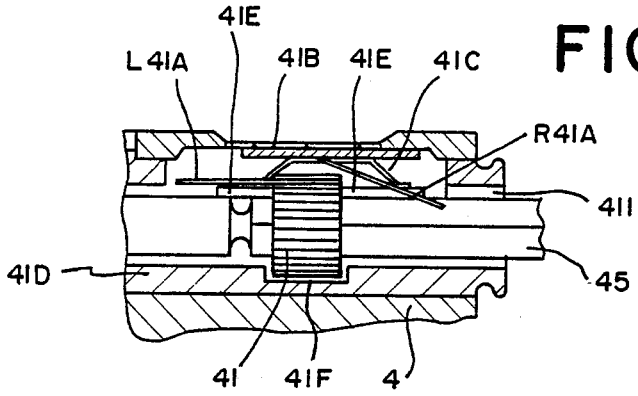
FIG. 5B
FIG.5C
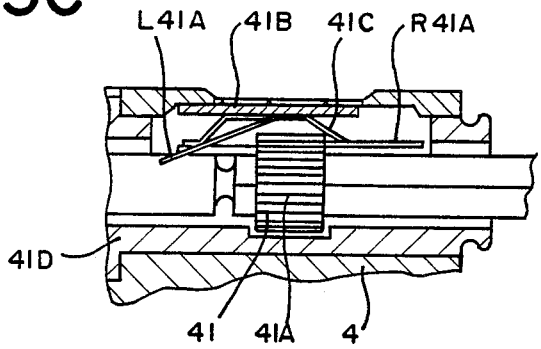

MULTIPURPOSE TOOL

BACKGROUND OF THE INVENTION

1. Field of the Invention

The present invention generally involves the field of technology pertaining to tools for different purposes. More particularly, the invention relates to an improved tool device wherein a plurality of interchangeable tool bits may be selectively utilized with a single tool for different purposes.

2. Description of the Prior Art

Hand held tools for performing various and different work functions are well known in the art. For example, the driving of screws usually requires a screw driver having either a straight edge configuration or a Phillips configuration. The sizes of these tools shall necessarily vary in accordance with the sizes of the correspondingly configured screws. A workman is therefore required to have available many different tools in order to accommodate the different screws which are typically required to complete a given work project. In addition to screw drivers, other hand held implements, such as chisels, awls, scrapers, and the like, are also required for performing conventional and related work functions.

In order to alleviate the requirement of maintaining an inventory of many different tools for anticipated needs, multipurpose tools have been developed. For example, it is known to form a screwdriver with a hollow handle for storing a plurality of different driver bits which can be interchangeably utilized with the handle. A tool of this type requires manual selection of the tip from its storage compartment and assembly of the tip in its operational position on the handle. Another type of known multipurpose tool is disclosed by the Graham U.S. Pat. No. 4,572,038 wherein the tool utilizes a cylinder assembly provided with a plurality of chambers which house different tool tips, with the cylinder being rotatable so that each cylinder may be selectively indexed into alignment with a barrel portion for receiving the selected bit through operation of a reciprocating shaft.

Conventional multipurpose tools generally require a considerable amount of manual manipulation or are susceptible to break down during use due to the application of large torque forces.

SUMMARY OF THE INVENTION

It is an object of the present invention to provide an improved multipurpose tool capable of performing different functions.

It is another object of the invention to provide an improved multipurpose tool which is easy to use and reliable during operation.

It is a further object of the invention to provide an improved multipurpose tool wherein different tool bits may be quickly and selectively engaged by the tool to perform different required functions.

It is yet another object of the invention to provide an improved multipurpose screwdriver device which is capable of efficiently changing between different driver bits of straight edge or Phillips configurations and of different sizes.

These and other objects of the invention are realized by providing a multipurpose tool which is particularly useful as a screwdriver device and includes, as its essential components, a front barrel assembly, a revolver, a hexagonal plate assembly, a rear barrel assembly, a handle, an actuating shaft and a plurality of different tool bits. The revolver includes a plurality of hexagonalshaped chambers within which a corresponding number of tool bits are secured by means of leaf springs. A trigger operated ratchet plate engages the hexagonal plate assembly for indexing the revolver and aligning the desired bit with a bore formed in the front barrel. The actuating shaft is thrust forwardly to engage the desired bit and charge same into an operative position at the forward end of the front barrel, at which point the tool may be used to perform the desired function attended for the selected bit. The too may be used to either apply torque to the bit or impact force to the bit upon striking the rear end of the actuating shaft. The bit is engaged within the end of the actuating shaft so that its removal from the front barrel may be effected by retracting the shaft to a point where an inwardly extending tab of a restriction plate carried by the hexagonal plate assembly serves to release the bit from the shaft, thereby permitting the revolver to rotate freely for further indexing by the trigger.

Other objects, features and advantages of the invention shall become apparent from the following detailed description of a preferred embodiment thereof, when taken in conjunction with the drawings wherein like reference characters refer to corresponding parts of the several views.

BRIEF SUMMARY OF THE DRAWINGS

FIG. 5A is a partial perspective view of a ratchet mechanism which may be used in the practice of the invention.

FIGS. 5B and 5C are partial front elevational views of the ratchet mechanism shown in FIG. 5A.

DETAILED DESCRIPTION OF THE PREFERRED EMBODIMENT

Figure 1:
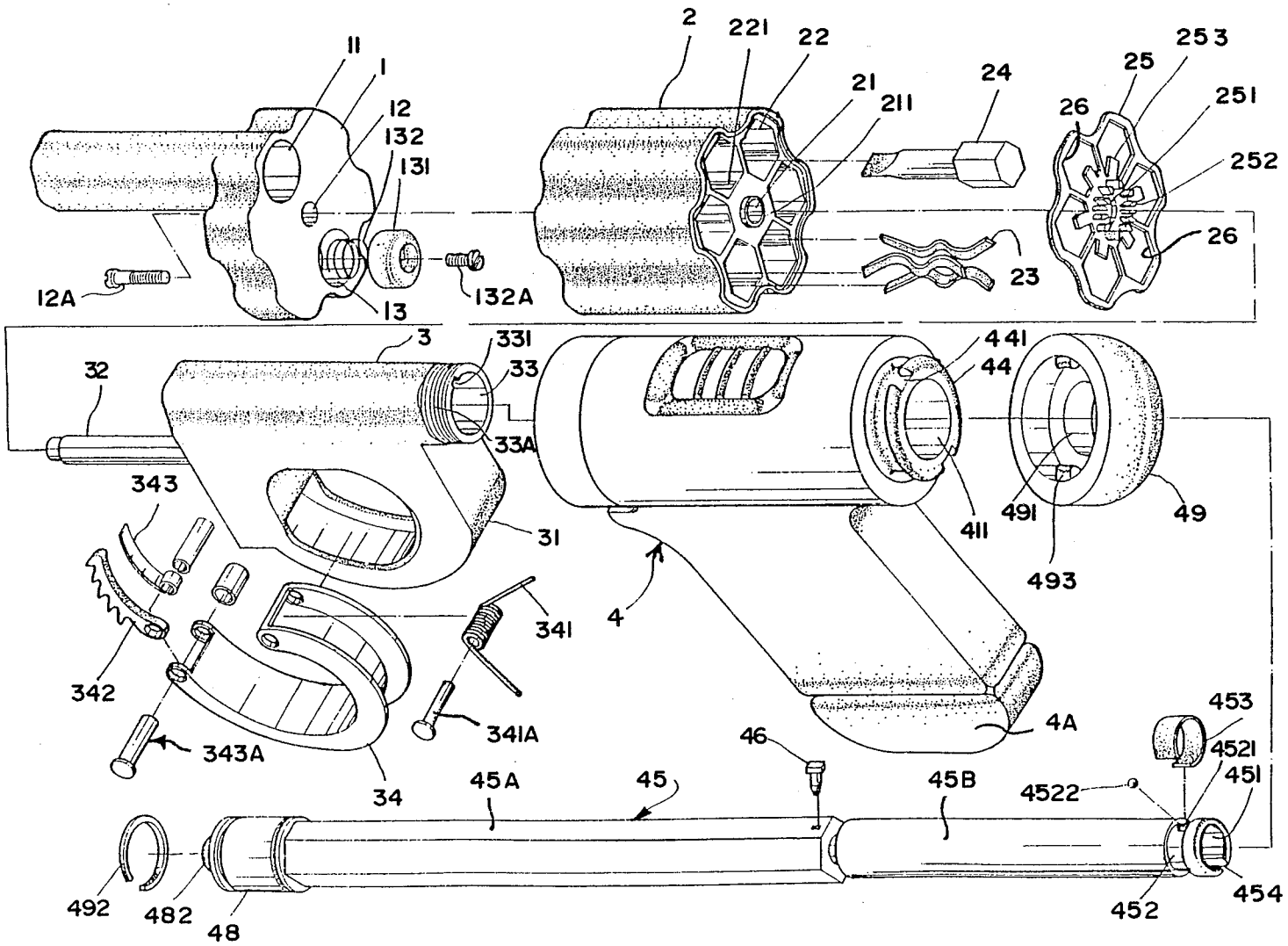
FIG. 1 is an exploded perspective view of a multi purpose tool according to a preferred embodiment of the invention.

With initial reference to FIG. 1, a multipurpose tool according to a preferred embodiment of the invention is shown in an exploded and unassembled form. The tool includes, as its essential components, a front barrel assembly 1, a revolver 2, a rear barrel assembly 3, a handle assembly 4 and a hexagonal plate assembly 25.

Front barrel assembly 1 includes a longitudinal bore 11 having a larger diameter at its rearward end and a smaller diameter at its forward end for accommodating the configuration of a tool bit 24. Assembly 1 also includes a central passageway 12 for receiving a screw 12A. An offset hole 13 is provided in assembly 1 for receiving an alignment button 131 which is secured therein against the bias of a spring 132 by a screw 132A. As apparent, spring 132 serves to bias button 131 outwardly, though button 131 is permitted to be urged inwardly into opening 13 against the bias of spring 132.

Revolver 2 is of substantially cylindrical configuration and is defined by a circular array of longitudinal chambers 22, with each chamber 22 having a hexagonal-shaped cross sectional configuration. Revolver 2 also includes a centrally disposed hollow shaft 212 which terminates rearwardly in the form of a stopper 211. Each chamber 22 is provided with 3 leaf springs 23 which are engaged in three corresponding grooves 221 formed in the wall of the chamber in a triangular array. Leaf springs 23 serve to centrally maintain tool bits 24 along the longitudinal axes of chambers 22. The forward end of revolver 2 is provided with a flat surface. The rearward end of revolver 2 is provided with an appropriate configured depression for receiving correspondingly configured hexagonal plate assembly 25.

Plate assembly 25 is provided with a circular array of hexagonal openings 26 corresponding in size and configuration with the rearward end openings of chambers 22 for accurate alignment therewith. Assembly 25 also includes a central hole 251 for receiving stopper 211. A plurality of ratchet tongues 252 surround hole 251, with three tongues 252 being allocated for each hexagonal opening 26. Each hexagonal opening 26 further includes a restriction plate provided with a plurality of tabs 253 extending radially outwardly from the center of hole 251 and with each tab 253 terminating substantially at the center of each corresponding hexagonal opening 26.

Figure 2:
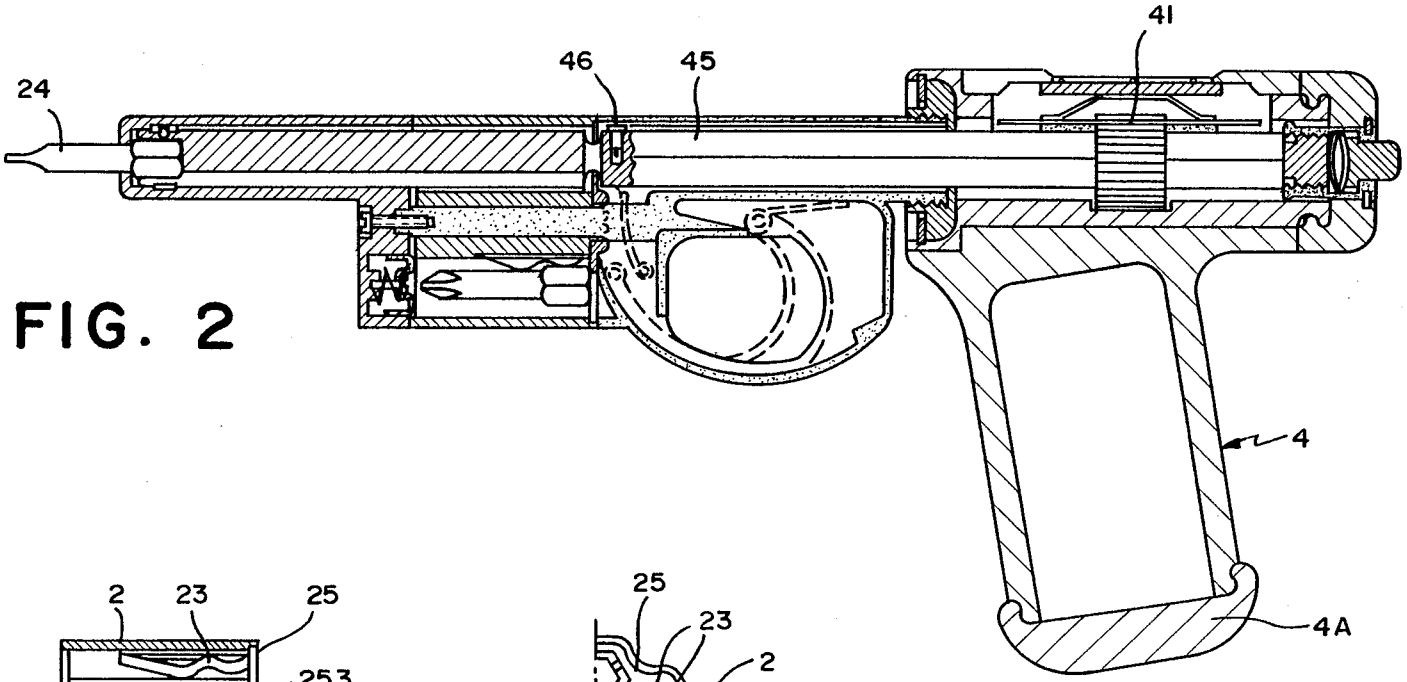
FIG. 2 is a front elevational cross sectional view showing the tool in a position of use with a selected tool bit engaged at the forward end of the front barrel.
Figure 3:
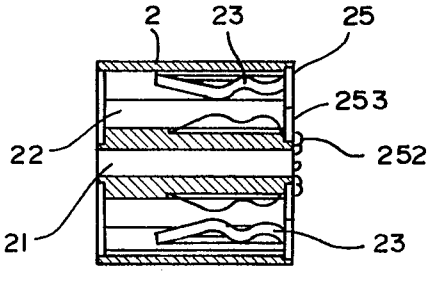
FIG. 3 is a longitudinal cross sectional view of the revolver used in the tool for holding a plurality of tool bits, and particularly depicting the hexagonal-shaped chambers with leaf springs for securing the tool bits therein.
Figure 5:
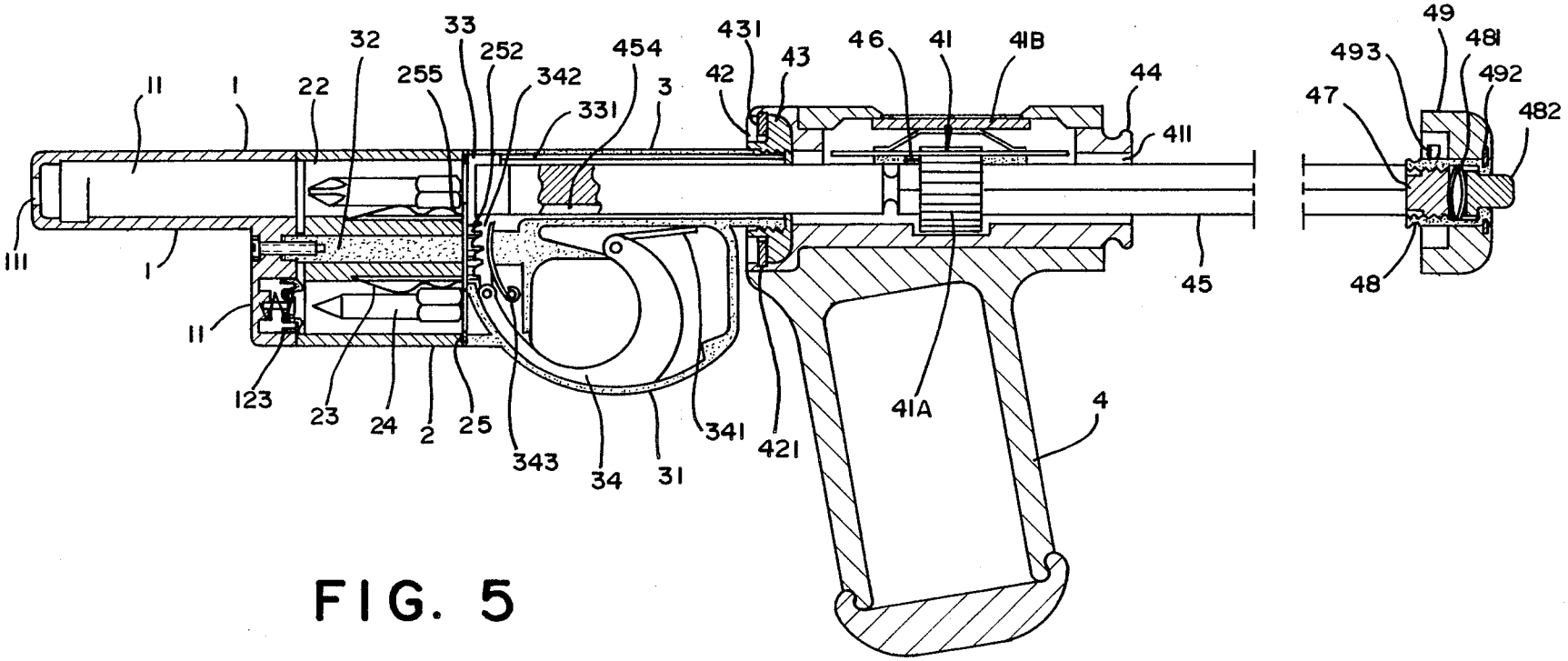
FIG. 5 is a front elevational cross sectional view showing the tool with the actuating shaft extended in a position for charging a selected tool bit into the front barrel.
Figure 6:
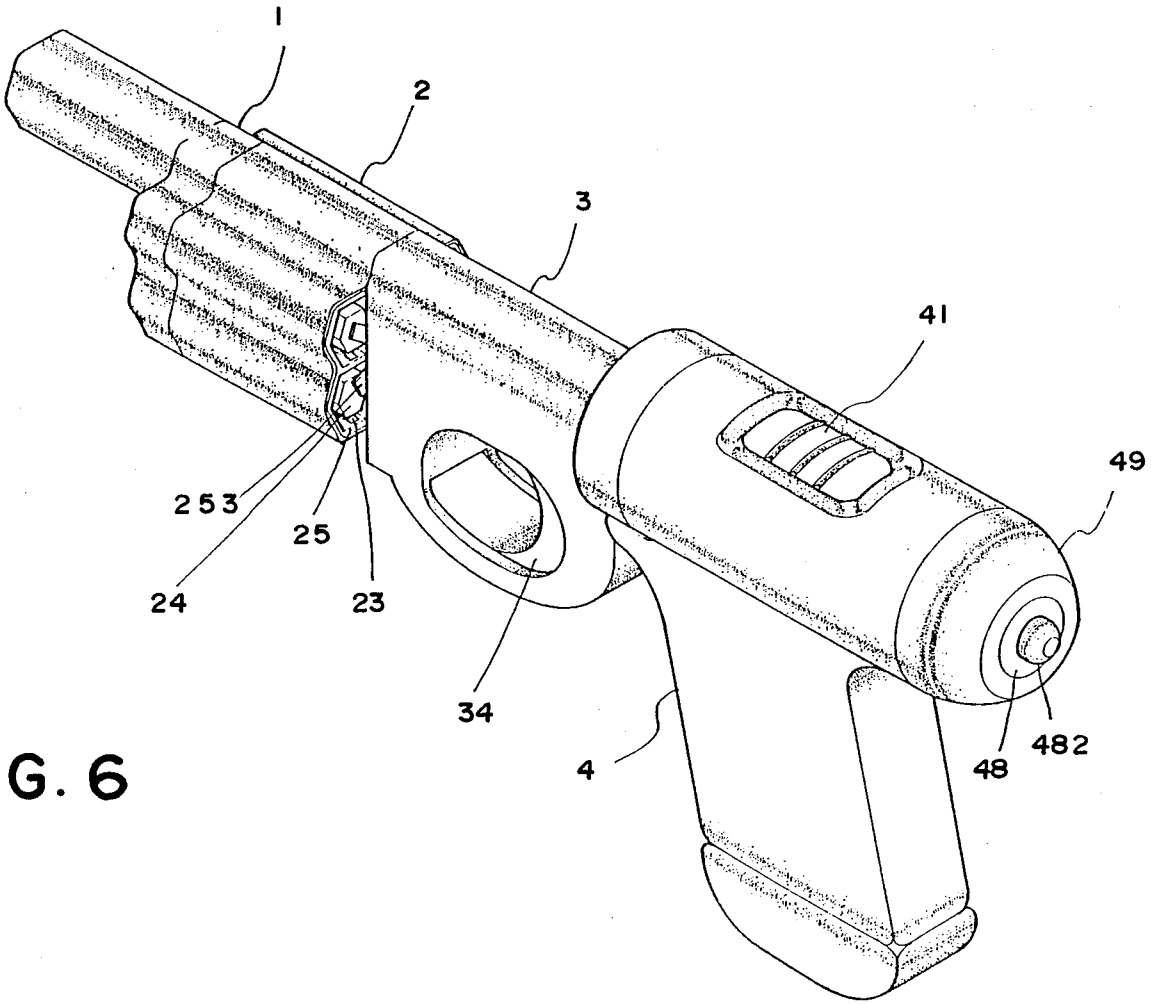
FIG. 6 is a rear perspective view of the tool in a fully assembled condition.

Rear barrel assembly 3 is preferably defined by a casing having an integrally formed trigger guard 31. A main shaft 32 extends forwardly of assembly 3 and includes three sections of different diameters. The first section is disposable through central passage 12 of front barrel assembly 1 and includes an internally threaded portion for engagement by screw 12A. The second section is sized for disposition within hollow shaft 211 to rotatably support revolver 2 thereon. The third section is secured by revolver 2 and disposed between front barrel assembly 1 and rear barrel assembly 3, as seen in FIGS. 2 and 5. As further indicated, the upper portion of assembly 3 includes a longitudinal barrel bore 33 extending therethrough, with a longitudinal guideway 331 extending along the upper side of bore 33. A threaded portion 33A surrounds the entrance to bore 33. A trigger 34 is pivotally supported within and surrounded by trigger guard 31. One end of trigger 34 is secured by a coil spring 341 and an appropriate fastener 341A. The other end of trigger 34 is secured to a ratchet plate 342 for engagement With ratchet tongues 252 of hexagonal plate assembly 25. A leaf spring 343 is also positioned within guard 31 and secured to one side of ratchet plate 342 and the corresponding end of trigger 34 by an appropriate fastener assembly 343A.

Handle assembly 4, as shown in FIG. 5, includes a hollow compartment provided with a removable cover 4A for storage of tool bits 24. The upper end of assembly 4 is provided with a longitudinal bore 411. As further seen in FIGS. 5A–5C, an appropriate known torque applying ratchet assembly 41, preferably of the type that is reversible and includes a gear 41A and a reversing switch assembly 41B, is disposed within bore 411. The forward end of bore 411 is provided with an annular groove 42 for receiving a C-shaped ring 431 and a nut 43 for engaging threaded portion 33A of rear barrel assembly 3 to secure assembly 3 to assembly 4. At the rearward end of bore 411, there is provided an annular cap seat 44 having opposed gaps 441 formed therein for receiving and securing a cap 49 provided with a pair of corresponding locking wedges 493 and a central inner cylinder hole 491, a seen in FIG. 1.

Actuating shaft 45 includes hexagonal shaped section 45A and a cylindrical shaped section 45B joined together at corresponding ends to define a common longitudinal axis. The free end of section **45*b* is provided with hexagonal-shaped hole 451 extending longitudinally therethrough, with hole 451 being surrounded by an annular groove within which a C-shaped spring 453 may be secured. Groove 452 further includes a seat 4521 within which a ball bearing 4522 is disposed and urged inwardly by means of spring 453. The free end of section 45B is also provided with a guideway 454 which extends longitudinally along the bottom portion of shaft 45B. A lock screw 46 is provided in section 45*a* for a purpose to be hereinafter detailed, and also preferably for assembling section 45A and 45B together to form shaft 45. The free end of section 45A is provided with a threaded assembly screw 47 which is engaged by a correspondingly threaded assembly cylinder 48 which is in turn secured within central passage 491 of cap 49 by a C-ring 492 which restricts the rotation of cylinder 48 relative to cap 49. As shown in FIG. 5, an impact head 482 is also secured within cylinder 48, with a spring washer 481 being interdisposed between screw 47 and head 482 for providing resiliency to head 482. As also noted, head 482 extends outwardly from the rear portion of cap 49 for engagement by an appropriate impact tool. Section 45A extends slidably through a corresponding hexagonal-shaped bore through gear 41A of ratchet mechanism 41 within bore 411**.

MODE OF OPERATION

Figure 4:
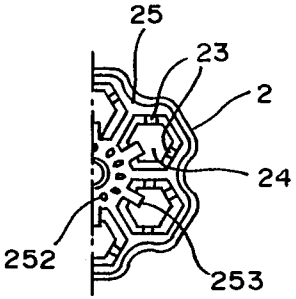
FIG. 4 is a partial transverse cross sectional view showing the revolver with a plurality of tool bits secured therein.

With the multipurpose tool in its fully assembled position of use as depicted in FIG. 2, a plurality of tool bits 24 are inserted within their corresponding chambers 22 of revolver 2, as seen in FIG. 4. Bits 24 may be of straight edge or Phillips configuration, or for that matter any other type of tool bit configuration and function desired for the practice of the invention. In the position shown in FIG. 2, a tool bit 24 is properly engaged for use at the forward end of front barrel assembly 1. In this position, the rear end of bit 24 is secured within hexagonal hole 451 of section 45B by virtue of ball bearing 4522 being urged radially inwardly under the bias of spring 453. Lock screw 46 is disposed in sliding engagement within longitudinal guideway 331 of bore 33 in rear barrel assembly 3. Moreover, a corresponding restriction plate tab 253 of hexagonal plate assembly 25 is disposed in sliding engagement within longitudinal guideway 454 of section 45B. Finally, cap 49 is secured to the rear end of handle 4 through the engagement of wedges 493 through gaps 441 and rotation of cap 49 against cap seat 44. The tool bit 24 in this position is therefore ready for use through application of torque to bit 24 with ratchet mechanism 41 or impact force applied to head 482, depending upon the nature and intended function of bit 24.

When it is desired to replace bit 24 cap 49 is rotated to a position wherein wedges 493 are released from seat 44 through gaps 441. Shaft 45 may then be fully extended outwardly from the rear of the tool as shown in FIG. 5. When this occurs, guideway 454 of section 45B slides relative to its corresponding restriction plate 253 and guideway 331 of bore 33 also slides relative to screw 46. Continued movement shall cause restriction plate tab 253 to engage the rear end of tool bit 24 and release same from section 45B. This serves to dispose bit 24 back in its corresponding chamber 22 and in engagement by leaf springs 23. With shaft 45 fully extended in its rearward position, revolver 2 is free to rotate by actuating trigger 34 so that ratchet plate 342 engages ratchet tongues 252, thus causing each chamber 22 to be successively indexed and aligned with bore 11, with such alignment being assured by button 131 which engages the forward end of each chamber 22. When the desired bit 24 is in position, shaft 45 is retracted within the tool in a reverse manner and cap 49 is secured to seat 44, thus causing the selected bit 24 to be changed into the forward end of front barrel assembly 1, as shown in FIG. 2. The tool is therefore ready for reuse with another bit 24.

It is to be understood that the form of the invention herein shown and described is to be taken as a preferred embodiment of the same, and that various changes and modifications may be resorted to by one of ordinary skill in the art without departing from the spirit of the invention or scope of the subjoined claims.

What is claimed is:

1. A multipurpose tool comprising:

(a) a front barrel assembly including a first bore therethrough;

(b) a rear barrel assembly including a second bore therethrough;

(c) a revolver including a plurality of chambers for storing tool bits, the revolver being supported for rotation between the front and rear barrel assemblies;

(d) a trigger assembly carried by the rear barrel assembly for rotating the revolver and successively indexing each chamber into alignment with the first bore, which trigger assembly includes a hexagonal plate carried by the revolver, the plate being provided with a plurality of openings aligned with and corresponding to the configuration of the chambers and a plurality of ratchet tongues, a pivotal trigger, a ratchet plate carried by the trigger, and wherein upon pivotal movement of the trigger, the ratchet plate engages the ratchet tongues to rotate the revolver;

(e) a handle secured to the rear barrel assembly and including a third bore; and (f) an actuating shaft slidably supported within the first, second and third bores for sliding movement between a fully retracted position wherein the shaft is positioned within the first, second and third bores for maintaining a selected tool bit in a position of use at a forward end of the front barrel assembly, and a fully extended position wherein the shaft is positioned in the second and third bores to permit free rotation of the revolver upon actuation of the trigger means.

2. The multipurpose tool of claim 1 wherein the openings in the hexagonal plate and the cross sectional configuration of the chambers are each of a hexagonal-shaped configuration, and each chamber includes a plurality of leaf springs for aligning and maintaining a tool bit therein.

3. The multipurpose tool of claim 1 wherein the actuating shaft includes attachment means at one end thereof for securing a tool bit thereto and a longitudinal guideway, the hexagonal plate includes a restriction plate tab positioned at each opening, whereby when the shaft is disposed in its fully extended position, the restriction plate tab of a corresponding opening engages a tool bit to release same from the securing means and reposition the bit within the chamber.

4. The multipurpose tool of claim 3 wherein the other end of the actuating shaft includes a cap and an impact head, and the handle assembly includes a cap seat, whereby when the shaft is in its fully retracted position, the cap is engaged with the cap seat and permits the impact head to be struck by an impact tool.

5. The multipurpose tool of claim 1 further including a reversible ratchet mechanism disposed within the handle and slidably engaged by the actuating shaft.

6. The multipurpose tool of claim 1 wherein the handle includes a hollow storage compartment and a removable cover therefor.

* * * * *